US007322471B2

(12) United States Patent
Cleaver

(10) Patent No.: US 7,322,471 B2
(45) **Date of Patent: *Jan. 29, 2008**

(54) SHOCK ABSORBING APPARATUS AND METHOD

(75) Inventor: Brian Cleaver, Fremont, CA (US)

(73) Assignee: SPI/Semicon, Inc., Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/050,263

(22) Filed: Feb. 1, 2005

(65) Prior Publication Data

US 2005/0133403 A1 Jun. 23, 2005

Related U.S. Application Data

(63) Continuation of application No. 10/326,482, filed on Dec. 20, 2002, now Pat. No. 6,848,579, which is a continuation-in-part of application No. 09/427,199, filed on Oct. 25, 1999, now Pat. No. 6,662,950.

(60) Provisional application No. 60/347,347, filed on Jan. 8, 2002.

(51) Int. Cl.
*B65D 85/48* (2006.01)

(52) U.S. Cl. ..... 206/454; 206/710

(58) Field of Classification Search ..... 206/454, 206/710, 449, 832, 523

See application file for complete search history.

(56) References Cited

U.S. PATENT DOCUMENTS

| | | | |
|---|---|---|---|
| 1,546,312 | A | 7/1925 | Patton et al. |
| 1,720,327 | A | 7/1929 | Halvorson |
| 3,469,686 | A | 9/1969 | Gutsche et al. |
| 3,482,682 | A | 12/1969 | Cronkhite |
| 3,552,548 | A | 1/1971 | Wallestad et al. |
| 3,661,253 | A | 5/1972 | Cronkhite |
| 3,672,495 | A | 6/1972 | Bauer et al. |
| 3,759,416 | A | 9/1973 | Constantine |
| 3,918,581 | A | 11/1975 | Scammon, Jr. et al. |
| 3,992,811 | A | 11/1976 | Yellin |
| 4,057,142 | A | 11/1977 | Lechner et al. |
| 4,405,057 | A | 9/1983 | Stein |
| 4,588,086 | A | 5/1986 | Coe |
| 4,787,508 | A | 11/1988 | Wu et al. |
| 4,844,263 | A | 7/1989 | Hadtke |
| 4,874,088 | A | 10/1989 | Leben |
| 5,025,926 | A | 6/1991 | Gregerson et al. |
| 5,040,678 | A | 8/1991 | Lenmark, Sr. et al. |
| 5,474,177 | A | 12/1995 | Abrams et al. |
| 5,553,711 | A | 9/1996 | Lin et al. |
| 5,641,090 | A | 6/1997 | Kowalski et al. |
| 5,673,795 | A | 10/1997 | Clatanoff et al. |
| 5,699,925 | A | 12/1997 | Petruzzi |

(Continued)

*Primary Examiner*—Shian T Luong
(74) *Attorney, Agent, or Firm*—GSS Law Group; Gregory Scott Smith

(57) ABSTRACT

A shock absorber designed for insertion within a container. The shock absorber presents a support surface on one side intended to contact the surface of one or more items contained within the container, and a spring side including compression elements, in contact with an interior surface of the container, intended to urge the support surface into contact with the items contained within the container. Use of the Shock absorber of the invention may eliminate the need for foam inserts or cushions, which can greatly reduce outgassing of anions or cations generally associated with foam. The container and shock absorber may be suitable for reuse and recycling.

4 Claims, 6 Drawing Sheets

U.S. PATENT DOCUMENTS 5,724,748 A 3/1998 Brooks et al.
5,775,508 A 7/1998 Bongard et al.
5,947,318 A 9/1999 Palm
5,984,130 A 11/1999 Hayes et al.
6,119,865 A 9/2000 Kawada
6,237,771 B1 5/2001 Haq
6,286,684 B1 9/2001 Brooks et al.
6,533,123 B1 3/2003 Nakamura et al.
6,550,619 B2 4/2003 Bores et al.

SHOCK ABSORBING APPARATUS AND METHOD

CROSS REFERENCE TO RELATED APPLICATIONS

This application is a continuation of U.S. Utility application Ser. No. 10/326,482 filed Dec. 20, 2002, now U.S. Pat. No. 6,848,579, which is a continuation-in-part of U.S. Utility application Ser. No. 09/427,199 filed Oct. 25, 1999 now U.S. Pat. No. 6,662,950. This application further claims the benefit of U.S. Provisional Application No. 60/347,347 filed Jan. 8, 2002. The specifications and drawings of these applications are hereby incorporated by reference in their entirety.

FIELD OF THE INVENTION

The present invention relates to shock absorbing apparatus used as part of a packaging system or shipping and storage system for storing and transporting delicate objects, such as silicon wafers. The invention also relates to a method for storing and transporting delicate objects.

BACKGROUND OF THE INVENTION

Various containers have been used in the electronics industry to transport semiconductor wafers. Semiconductor wafers are generally very thin and fragile disks made from silicon. The fragile nature and high value of semiconductor wafers requires a very reliable means for storing and transporting them within a container.

A continued trend in the electronics industry is an increase in size, and decrease in thickness, of the wafers. As the size and surface area increase, and the thickness decreases, new techniques must be found to protect semiconductor wafers from damage.

Sources of damage to semiconductor wafers during storage and shipping include, but are not limited to, vibration, abrasion, impacts, particulation, static electricity, and outgassing.

During the manufacturing process, it is often necessary to move wafers from a first manufacturing facility to a second manufacturing facility for further processing. This requires that the wafers be removed from the first production assembly, then packaged and moved or shipped to the second facility, where they are unloaded for further processing.

To prevent damage to the wafer, or contamination of, the surface of the wafer, wafers are often handled by the edges Consequently, many known semiconductor wafer containers are configured to store wafers in stacked cassettes supporting the wafers only at the edges.

The use of rigid supports on the wafer's edges is not sufficiently effective in protecting larger, more delicate wafers during shipping. Furthermore, many existing shipping containers have not been well adapted for handling by automated machinery, thus requiring manual intervention at various stages of the loading and unloading process. Every step requiring manual handling of the wafers increases contamination problems. In the manufacture of semiconductor wafers, there is an inverse relationship between chip yield and particle contamination.

What is needed are Containers that fully support the entire surface of semiconductor wafers, are configured for automated handling machines, provide protection against particle contamination and static discharge damage, and are produced from materials that limit problems that may arise from outgassing. What is further needed is a shock absorbing apparatus and method of packaging that are compatible with newly developed containers and wafer sizes, and that protect against vibration, abrasion, impacts, particulation, static electricity, and outgassing.

SUMMARY OF THE INVENTION

Configured in accord with the invention, a shock absorber is designed for insertion within a shipping and storage container. The shock absorber presents a support surface on one side intended to contact the surface of one or more items contained within the container, and a spring side including compression elements, in contact with an interior surface of the container, intended to urge the support surface into contact with the items contained within the container. Preferably, two shock absorbers are used on opposite sides of the items or stack of items stored in the container In one embodiment, the shock absorber is a circular disk, the disk having a flat side, a spring side, a cylindrically shaped edge, and one or more compressible springs. The flat side has a smooth surface and a substantially level topology. The compressible spring or springs are attached to and protrude from the spring side of the disk.

In other embodiments, the shock absorber has rotational stabilizers to prevent the shock absorber from rotating within a container, the rotational stabilizer or stabilizers extending from the cylindrically shaped edge of the disk, and then extend perpendicularly from the plane formed by the flat side of the disk.

In other embodiments, the shock absorber has an inner annular wall protruding from the surface of the spring side of the shock absorber and an outer annular wall protruding from the surface of the spring side of the shock absorber. In this embodiment, the compressible spring elements extend further above the surface of the spring side of the shock absorber than the inner and outer annular walls.

In some embodiments, the invention further comprises a separable base configured to hold a plurality of wafers stacked one on top of the other within a cylindrical storage area, and a cover configured to fit over portions of the base to enclose the stored wafers. More specifically, the carrier of the invention comprises a base with a deck having at least one wall defining the roughly cylindrical storage area, and a cover including a lid having a cylindrical recess configured to fit over and around the vertical wall of the base.

In some embodiments, the base of the container includes four roughly identical walls with gaps between the ends of each wall. In other embodiments, these walls are hollow and may be used for holding desiccants, preferably in sealed packages. In various embodiments, the container of the invention also includes a number of useful features, including features used to allow handling of both the container and the wafers by robots or automated machinery, a tamperproof seal, a locking means to prevent accidental opening of the container, stiffening ridges, and data storage means for storing data regarding the contents of the containers.

In use, the wafers are placed in vertical stacks within the cylindrical storage area defined by the vertical walls of the base, with lower wafers supporting the underside of upper wafers. Preferably, a protective material, including but not limited to cellulose, TYVEK, or foam discs, are placed between each pair of adjacent wafers.

DETAILED DESCRIPTION OF THE INVENTION

Disclosed in accord with the invention, is a shock absorber designed for insertion within a shipping and storage container. The shock absorber presents a support surface on one side intended to support one or more items contained within the container, and a spring surface on the side opposite the support surface. The invention is particularly suited for use in containers holding stacked wafers, however, the invention could be easily modified by one of ordinary skill for storing other materials including, hard disks, photomasks, liquid crystal displays, flat panel displays. Generally, one shock absorber is positioned on each side of a stack of wafers within the container. Use of the Shock absorber of the invention may eliminate the need for foam inserts or cushions, which can greatly reduce outgassing of anions or cations generally associated with foam. The container and shock absorber may be suitable for reuse and recycling.

In some embodiments, the shock absorbing apparatus used as part of a packaging system for storing and transporting disc shaped objects, such as silicon wafers. The invention also includes, a novel method for packaging disc shaped objects within a container, also including the shock absorbing apparatus of the present invention. For example, after the container is loaded and closed, it may be desirable to shrink wrap the container in an antistatic film. The container may also be placed within cushioned packaging for shipping, such as in a box containing foam padding or foamless packing boxes such as such as boxes including trampoline inserts which the inventors believe are called KORVU INSERTS™, made by Korvu Corporation.

Figure 1:
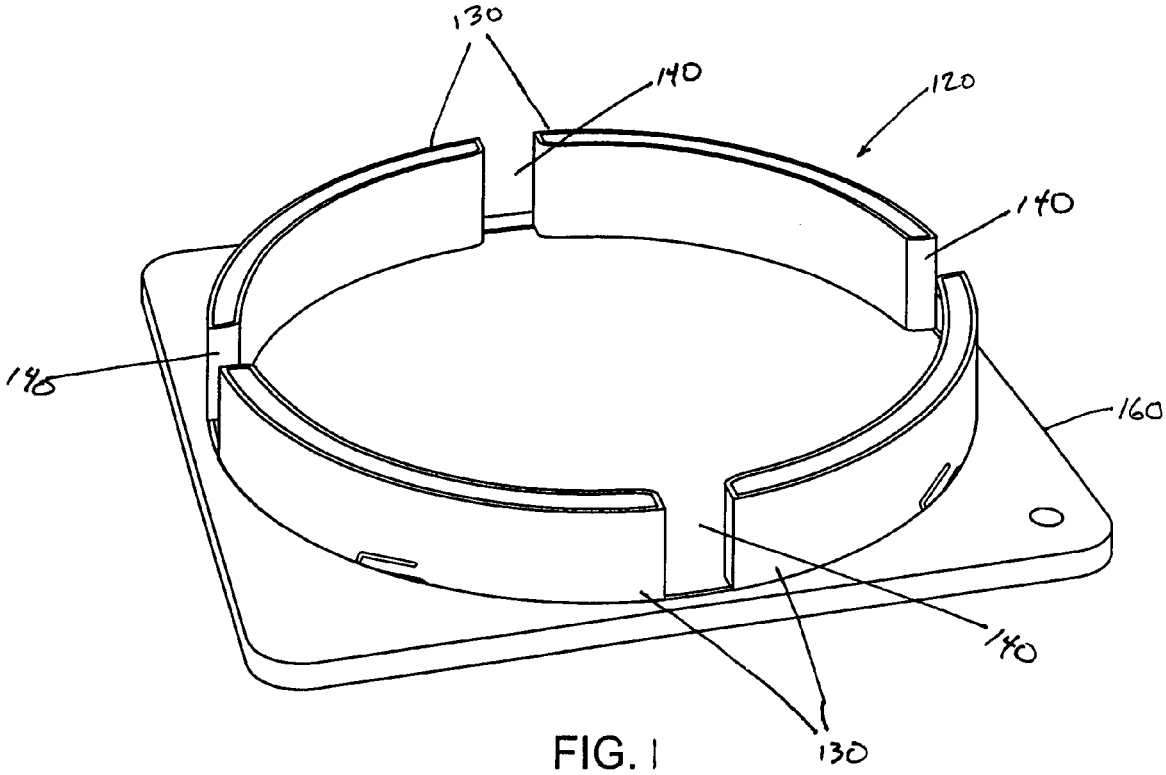
FIG. 1 shows a perspective view of the base portion of an embodiment of a shipping and storage container built according to the invention.

Referring to the drawings, and particularly to FIG. 1, a base 120 of an example shipping and storage container in which the shock absorbers of the invention may be used, is shown. The example container 100 has a container base 120, and a container cover 110 (best seen in FIG. 6).

The embodiment of the base 120 seen in FIG. 1 includes a flange 160 and four curved walls 130 that function to hold disc-shaped objects as they are stacked within the base 120. The walls 130 of the base 120 are separated by four gaps 140. In some embodiments, the gaps 140 may be required to allow access by a robotic arm or automated machinery to manipulate the discs and any associated packing within the storage area defined by the walls 130. In alternate embodiments, the number of walls 130 and the configuration and dimensions of the walls 130 and gaps 140 may be modified as desired.

Figure 6:
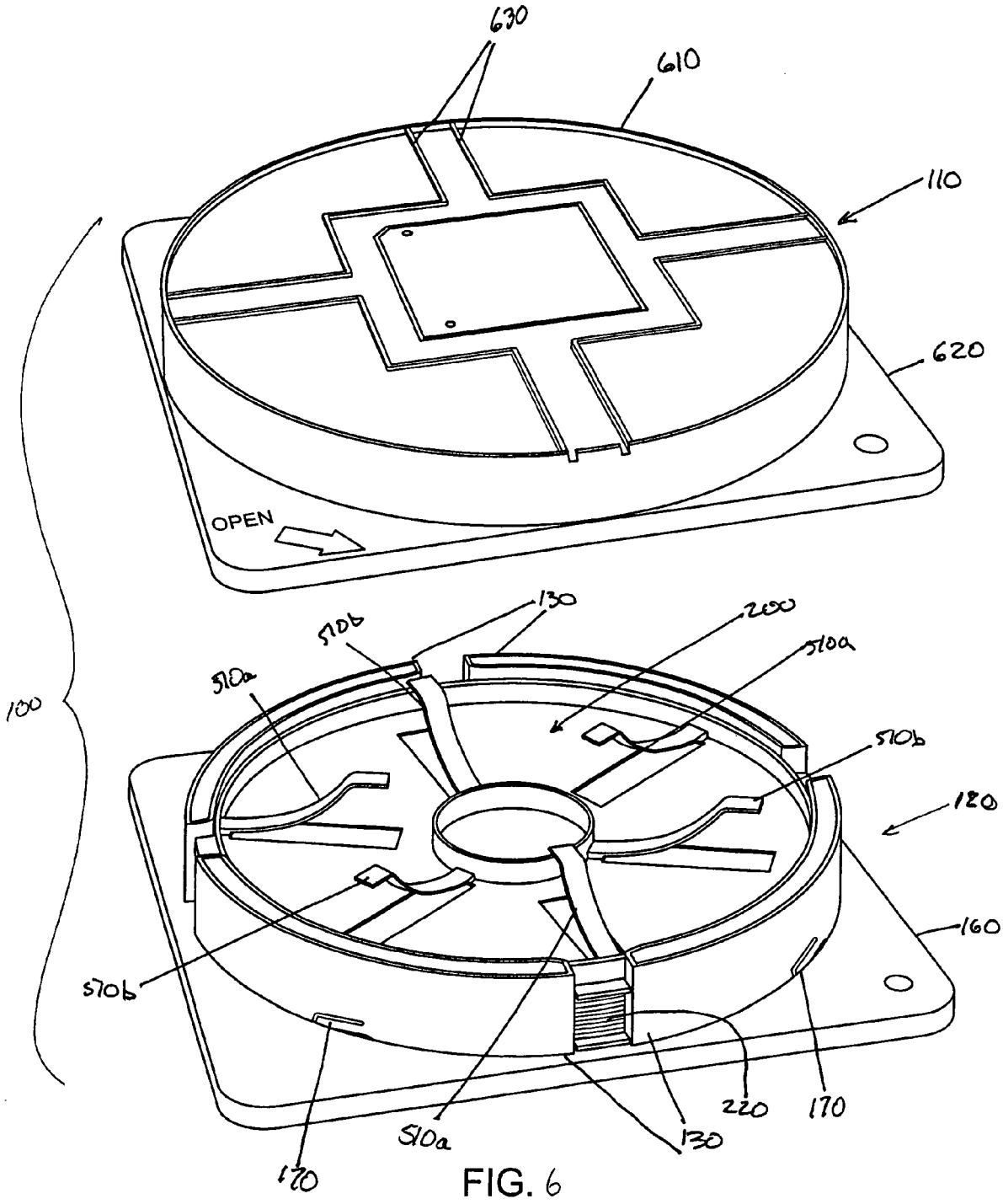
FIG. 6 shows a perspective view of the container of FIG. 5 further including a lid positioned above the base prior to the lid being lowered onto the base to seal the container.

As seen in FIG. 6, the container's cover 110 seals the container 100. The cover 110 preferably comprises a cylindrical lid 610 that defines a cylindrical recess to receive the walls 130 of the base 120. The cover 110 further preferably comprises a flange 620 similar in shape to the flange 160 of the base 120.

The raised ridges 630 on the top of the lid 610 preferably perform at least one of the following functions: (1) the ridges may add additional stiffness of the top of the cover 110, (2) the ridges may be configured to interlink with similar ridges formed on the bottom of the base 120 when multiple units are stacked, and (3) the ridges 630 may, when interlinked with a similar pattern on the base of an adjacent stacked container 100, define a protected area used to store a floppy disk or other data storage media containing information relating to the contents of the container 100. In alternate embodiments the dimensions and pattern of ridges 630 may be modified as desired, for example, to provide additional or different functional benefit or a different decorative appearance.

The container 100 may further include locking elements 170 for preventing or resisting the inadvertent separation of the cover 110 from the base 120 during use. Each locking element 170 interacts with a locking tab (not shown) formed on the inside wall of the cylindrical recess of the lid 610 of the cover 110 to hold the cover 110 securely on the base 120.

Generally, any useful or practical material may be used for fabricating the shock absorbers and container, including but not limited to any desired plastics such as a high density polyethylene (HDPE) compound, and plastic alloys. In other alternate embodiments, the materials used in fabrication can be chosen for custom uses, for example, the material used the fabricate the container 100 may be selected for resistance to damage in cold environments or exposure to selected chemicals, such as certain reagents used in the chip fabrication industry, detergents, acids, alkalis, and ultra violet light. The containers 100 may be readily fabricated in a variety of custom colors, and the colors can be used to color code the containers 100 for easy identification.

The container 100 is explained more fully in patent application Ser. No. 09/427,199, entitled Wafer Shipping and Storage Container, which is hereby incorporated by reference in its entirety. The container 100 may be easily modified by one skilled in the art to accommodate various common wafer sizes by scaling the dimensions of the container and shock absorbers accordingly.

Figure 2:
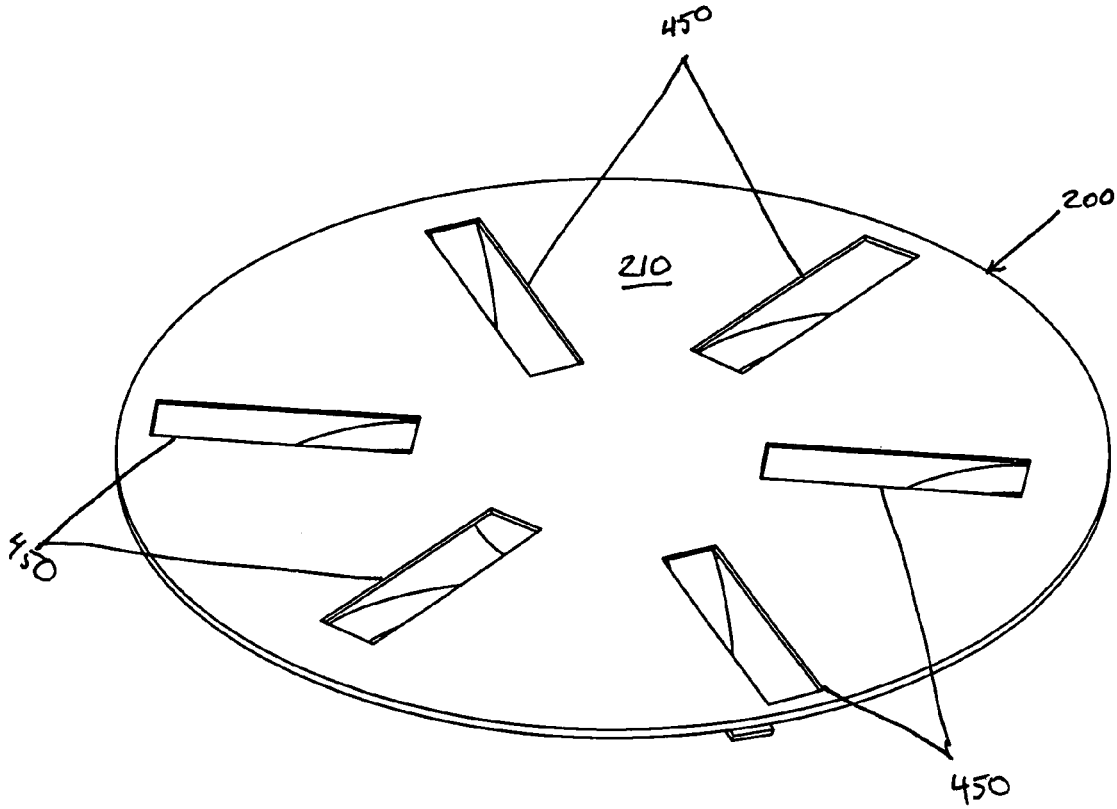
FIG. 2 shows a perspective view of the flat or disk contact side of the shock absorber seen in FIG. 1.

FIG. 2 shows a shock absorber 200 in isolation with the support side facing up. The surface of the flat side 210 of the shock absorber 200 is designed to support disc shaped object(s) 220 (seen in FIGS. 5 and 6), preferably with a protective material inserted within the container 100 between the disc shaped objects, and also between the upper and lower discs 220 and the shock absorbers 200. The surface of the flat side 210 of the shock absorber 200 is preferably smooth.

Figure 3:
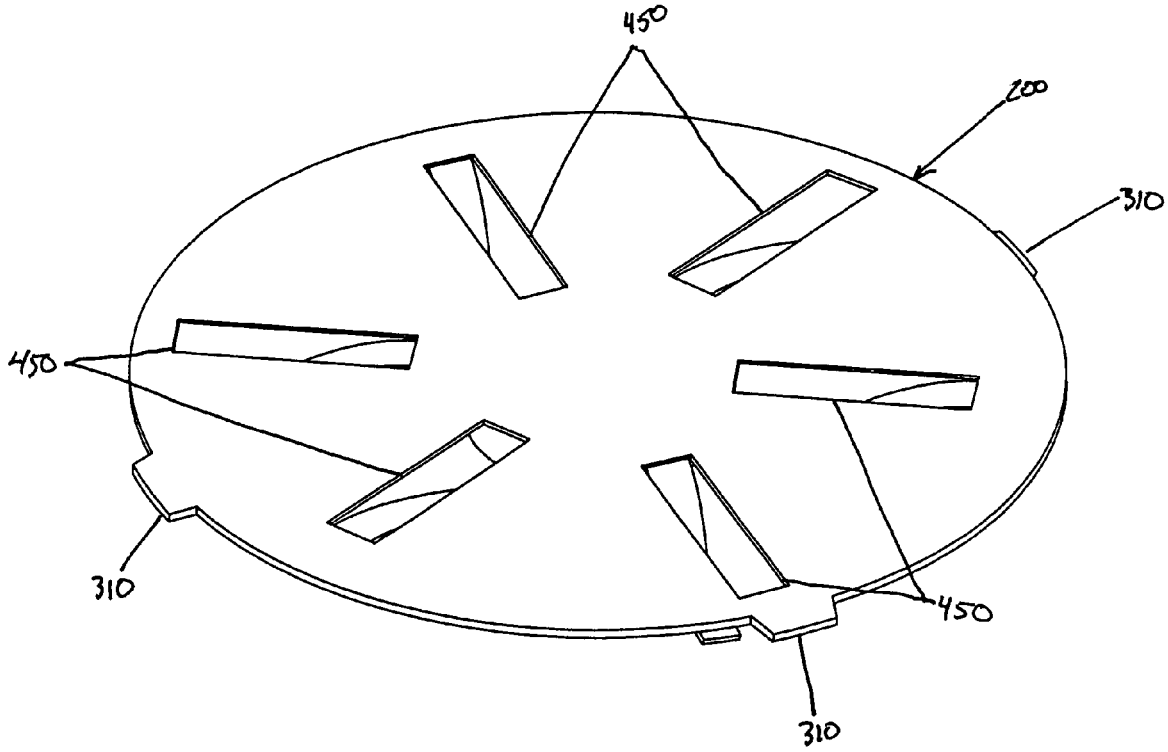
FIG. 3 shows a perspective view of an alternate embodiment of the device of FIG. 3 including rotational stabilizers.

In one embodiment, seen in FIG. 3, the shock absorber 200 also has rotational stabilizers, 310. These rotational stabilizers fit into the gaps 140 of the container's base 120, and prevent the shock absorber 200 from rotating. This feature prevents harm to the surfaces of the disc shaped objects 220 that might be caused by the shock absorber 200 rotating within the storage container 100.

Figure 4:
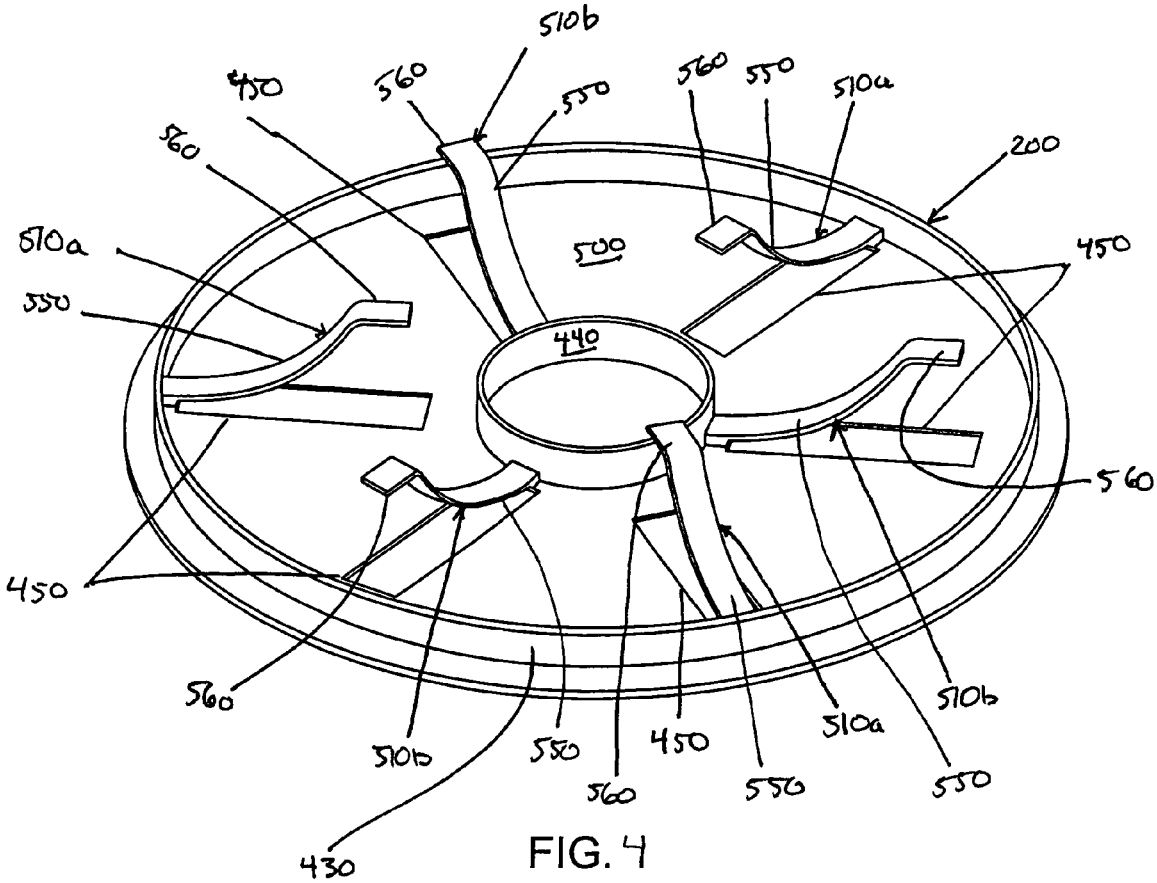
FIG. 4 shows a perspective view of the spring side of one embodiment of a shock absorber of the invention.

Referring to FIG. 4, the shock absorber 200 is preferably formed from a single piece of plastic. In the embodiments seen in FIGS. 2-6, an aperture 450 is formed in the shock absorber 200 when material is bent away from the surface 210 of the shock absorber 200 to form springs 510*a* and *b*.

In some embodiments, the shock absorber 200 is preferably molded from nylon or polypropylene. Preferred materials have the following characteristics: high strength, low weight, low particulation, low out-gassing, and resistance to the buildup of static charge.

In the embodiment seen in FIG. 4, spring side 500 of the shock absorber 200 includes six springs 510*a* and *b*. Three springs 510*a* originate at or near the outer annular wall 430 and radiate toward the center of the shock absorber 210. The other three springs 510*b* originate at or near the inner annular wall 440 and radiate toward the outer annular wall 430 of the shock absorber 200. Each spring 510*a* and *b* comprises a compressible sloping portion 550, and a contact portion 560. The sloping portion 550 is the part of the spring 510 that deflects. The contact portion 560 provides the contact surface between the spring 510 and the cover 110.

The six springs 510*a* and *b* are evenly spaced apart, so that each outer spring 510*a* radiating from the outer annular wall 430 is 60° away from each inner spring 510*b* radiating from the inner annular wall 440, and so on.

Upon compression, the outer springs 510*a* radiating from the outer annular wall 530 tend to compress downward toward the spring side 500 of the shock absorber, as do the inner springs 510*b* radiating from the inner annular wall 540. However, upon rebound, the outer springs 510*a* may tend to push back not only vertically, but also horizontally toward the perimeter of the shock absorber 210, because of the curved shape of the vertical sloping member 550 that is attached like a hinge at or near the outer annular wall 530. In contrast, the springs 510*b* radiating from the inner annular wall 540 tend to rebound vertically and may tend to push horizontally toward the center of the shock absorber 210. These opposing horizontal forces may tend to cancel each other, so that upon rebound, the springs tend to return the disc shaped objects 220 of the container 100 in a vertical direction relative to the container. Also, the use of many springs ensures the proper distribution of decompression forces. In some embodiments, a rib or other feature may be formed on the springs 550 to allow for tuning the springs 550 to adapt the shock absorber 200 to various wafer thickness and load weight requirements.

In some embodiments, the shock absorber may include outer and inner annular walls, 430 and 440, respectively. These walls prevent the springs 510*a* and *b* from deflecting any further toward apertures 450 than the height of the walls. The shock absorber 200 can be easily modified by one skilled in the art to provide adequate shock absorbing capabilities in light of the mass of the typical expected load that will be used in the container 100 with modifications to the configuration of the springs 510*a* and *b*, the number and position of springs 510*a* and *b*, and the material used in the formation of the springs 510*a* and *b*.

Figure 5:
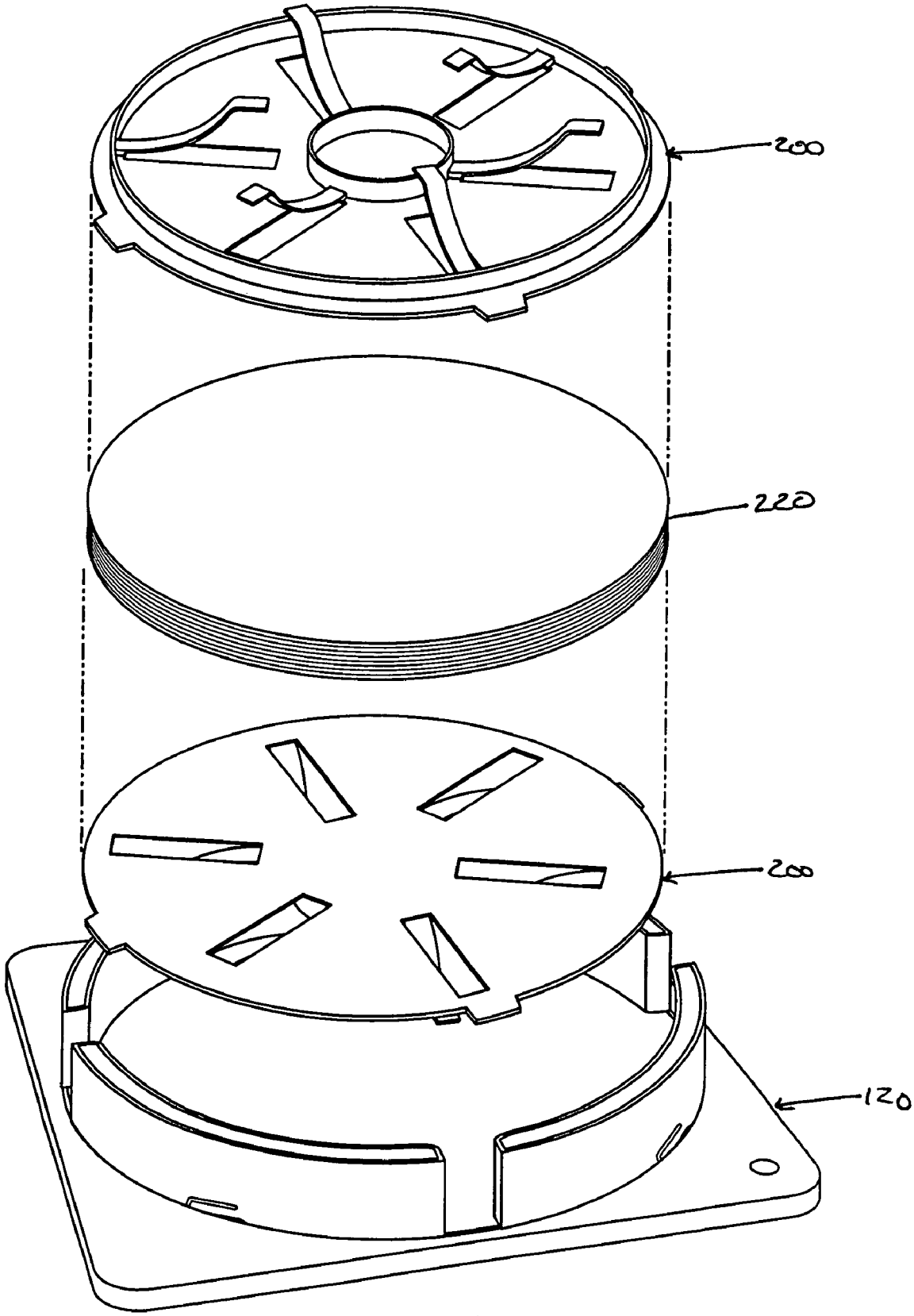
FIG. 5 shows an exploded view of the container of the invention further including a stack of disc shaped objects between a pair of shock absorbers.

FIG. 5 shows disc shaped objects 220 stacked between two shock absorbers 200 in the base 120 of a container 100. The first object to be inserted within the base 120 is the first shock absorber 200, followed by one or more disc shaped objects 220, and then by the second shock absorber 210. A preferred method of packaging includes the insertion of a protective material between each adjacent disc shaped object 220, as well as the insertion of a protective material between the disc shaped object(s) and the shock absorber 200. The protective material may comprise TYVEK™, cellulose, urethane foam, copper intercept, or a combination of such materials. The most preferred protective material is preferably tear resistant, relatively non-particulating, extremely low in sodium content (preferably below 1 PPM), extremely low in sulfur content (preferably below 1 PPM), and resistant to triboelectric charges. If cellulose discs are used, the discs are preferably 100% laboratory-grade low-lint cellulose with low sodium content (preferably around 169 PPM or less), and low sulfur content (preferably around 15-60 PPM or less). The copper intercept may comprise a copper loaded polyethylene or other material. In alternate embodiments, other materials than those described above may be useable, however, acceptable material will preferably be characterized by being non-corrosive, providing excellent cushion properties, providing ESO protection, and having low particulate generation.

FIG. 6 illustrates a container's base 120, packaged with a first shock absorber 200, one or more disc shaped objects, and a second shock absorber 200. To complete packaging of the container's disc shaped objects 220, the cover 110 is lowered onto the container's base 120, and is secured. Referring to FIG. 2, the orientation of the shock absorbers 200 shown is preferred because the springs 510*a* and *b* (Best seen in FIG. 5) do not contact the disc shaped objects 220. Instead, the springs 510*a* and *b* contact with the container's base 120 and cover 110, respectively. Therefore, the springs 510*a* and *b* can not harm the surface of the disc shaped objects 220 because the springs 510*a* and *b* are not in contact with the disc shaped objects.

What is claimed is:

1. A shipping and storage container for holding disk shaped objects, the shipping and storage container comprising:

a base including at least one wall having an inner circumference, defining a roughly cylindrical storage area with a first selected diameter, an outer surface, and at least one gap formed in the wall, and a cover including a lid comprising a cylindrical recess configured to fit over and around the wall of the base;

a support member having;

a support side;

a spring side; and at least one compressible attached to and protruding from the spring side of the support member.

2. The shipping and storage container of claim 1, wherein the cylindrical storage area is configured to receive disc shaped objects in vertical stacks with lower disc shaped objects supporting the underside of upper disc shaped objects.

3. The shipping and storage container of claim 2, wherein a protective material is placed between each pair of adjacent disc shaped objects.

4. The shipping and storage container of claim 3, wherein the protective material comprises a sheet of material formed from high density polyethylene fibers.

* * * * *